US011828022B2

(12) United States Patent
Choisnet

(10) Patent No.: US 11,828,022 B2
(45) Date of Patent: Nov. 28, 2023

(54) MARINE ROPE HAVING AN INDIVIDUAL COATING OF EACH CORE

(71) Applicant: IDEOL, La Ciotat (FR)

(72) Inventor: Thomas Choisnet, Marseilles (FR)

(73) Assignee: IDEOL, La Ciotat (FR)

( * ) Notice: Subject to any disclaimer, the term of this patent is extended or adjusted under 35 U.S.C. 154(b) by 319 days.

(21) Appl. No.: 17/282,207

(22) PCT Filed: Sep. 26, 2019

(86) PCT No.: PCT/FR2019/052286

§ 371 (c)(1),
(2) Date: Apr. 1, 2021

(87) PCT Pub. No.: WO2020/070413

PCT Pub. Date: Apr. 9, 2020

(65) Prior Publication Data

US 2021/0339830 A1 Nov. 4, 2021

(30) Foreign Application Priority Data

Oct. 2, 2018 (FR) ..... 1859108

(51) Int. Cl.
*D07B 1/02* (2006.01)
*B63B 21/20* (2006.01)
(Continued)

(52) U.S. Cl.
CPC ..... *D07B 1/025* (2013.01); *B63B 21/20* (2013.01); *D07B 1/04* (2013.01); *D07B 1/162* (2013.01);
(Continued)

(58) Field of Classification Search
CPC ..... D07B 1/025; D07B 1/04; D07B 1/162; D07B 2201/209; D07B 2501/2061; B63B 21/20
See application file for complete search history.

(56) References Cited

U.S. PATENT DOCUMENTS 3,265,809 A * 8/1966 Morieras ..... H01B 7/182 174/121 R
3,882,665 A 5/1975 Hughes et al.
(Continued)

FOREIGN PATENT DOCUMENTS

CN 201732191 U 2/2011
CN 104762843 A 7/2015
(Continued)

OTHER PUBLICATIONS

International Search Report in International Application No. PCT/FR2019/052286, dated Feb. 12, 2020, and English translation (7 pages).
(Continued)

*Primary Examiner* — Shaun R Hurley
(74) *Attorney, Agent, or Firm* — Bookoff McAndrews, PLLC

(57) ABSTRACT

The invention concerns the field of marine ropes, and more specifically a marine rope (1) comprising a plurality of cores (2; 2*a*, 2*b*), an individual coating (3) around each core (2; 2*a*, 2*b*), and a permeable protective sheath (4) around the plurality of cores (2; 2*a*, 2*b*). Each core (2; 2*a*, 2*b*) comprises a fiber strand or braid and each individual coating (3) is watertight and has a melting temperature lower than that of the corresponding core and an elongation at break greater than that of the corresponding core.

10 Claims, 3 Drawing Sheets

(51) Int. Cl.

| | |
|---|---|
| ***D07B 1/04*** | (2006.01) |
| ***D07B 1/06*** | (2006.01) |
| ***D07B 1/16*** | (2006.01) |

(52) U.S. Cl.

CPC *B63B 2021/203* (2013.01); *D07B 2201/1092* (2013.01); *D07B 2201/209* (2013.01); *D07B 2201/2044* (2013.01); *D07B 2205/2014* (2013.01); *D07B 2205/2064* (2013.01); *D07B 2501/2061* (2013.01)

(56) References Cited

U.S. PATENT DOCUMENTS

| | | | | | |
|---|---|---|---|---|---|
| 3,911,785 | A * | 10/1975 | Hood | D07B 1/04 87/8 |
| 4,624,097 | A * | 11/1986 | Wilcox | D07B 1/025 57/232 |
| 4,640,178 | A * | 2/1987 | Kurzbock | D07B 1/02 87/8 |
| 5,148,509 | A | 9/1992 | Kannabiran | |
| 9,627,100 | B2 * | 4/2017 | Pourladian | D07B 1/147 |
| 10,472,765 | B2 * | 11/2019 | Kirth | D07B 5/006 |
| 2012/0160082 | A1 * | 6/2012 | Erlendsson | D07B 1/02 57/7 |
| 2015/0050515 | A1 | 2/2015 | Gamba | |
| 2015/0113936 | A1 | 4/2015 | Amils et al. | |
| 2017/0328001 | A1 * | 11/2017 | Kirth | D07B 5/006 |
| 2020/0362511 | A1 * | 11/2020 | Hunter | D07B 1/025 |

FOREIGN PATENT DOCUMENTS

| | | | | |
|---|---|---|---|---|
| CN | 107103948 | A | 8/2017 | |
| DE | 202010013519 | U1 | 11/2010 | |
| EP | 0020130 | A1 | 12/1980 | |
| EP | 0252830 | A1 | 1/1988 | |
| EP | 2434050 | A1 | 3/2012 | |
| JP | 2014031602 | A | 2/2014 | |
| WO | 2006118465 | A1 | 11/2006 | |
| WO | WO-2016114671 | A1 * | 7/2016 | D07B 1/00 |
| WO | 2016190594 | A2 | 12/2016 | |
| WO | 2017178484 | A1 | 10/2017 | |
| WO | 2017199267 | A1 | 11/2017 | |
| WO | WO-2017199267 | A1 * | 11/2017 | D07B 1/025 |

OTHER PUBLICATIONS

French Search Report in French Application No. 1859108, dated Jun. 3, 2019 (2 pages).

Chinese search report and office action in Chinese Patent Application No. 201980065231.1, dated Jun. 15, 2022, 14 pages.

* cited by examiner

MARINE ROPE HAVING AN INDIVIDUAL COATING OF EACH CORE

CROSS-REFERENCE TO RELATED APPLICATION(S)

This application is the U.S. national phase entry under 35 U.S.C. § 371 of International Application No. PCT/FR2019/052286, filed on Sep. 26, 2019, which claims priority to French Patent Application No. 1859108, filed on Oct. 2, 2018.

BACKGROUND OF HE INVENTION

The present invention relates to the field of ropes and more specifically that of marine ropes, in particular those used for mooring lines.

When such mooring lines are used in shallow waters, the ropes must be protected from impacts, on the one hand, notably impacts with fishnets, and from marine organisms, on the other hand, that can implant themselves deep in the center of the ropes.

To protect marine ropes from impacts, the use of a protective sheath is known, for example, made of aramid fabric, as disclosed in Japanese patent application publication JP 2014-031602, a braided sheath, as in international application publication WO 2017/178484 A1 or German utility model DE 20 2010 013519 U1, or stranded steel wires, as in patent application publication US 2015/113936.

In order to prevent marine organisms, especially mollusks, from being able to nest in the center of the rope and damage it, the use of essentially watertight coatings, typically of polyurethane is known. These coatings can especially be positioned under the protective sheath, in order to also protect them from impacts, as disclosed in international patent application publication WO 2006/118465 or in European patent application publication EP 0,252,830 A1. However, the ropes used in long-term mooring lines can be subjected to very high cyclic loads, generating high heat. The passage of water through the rope to evacuate this heat and prevent the rope from melting may be impeded by coatings that protect against marine organisms. This impedes the use of large-diameter ropes in long-term mooring lines.

SUBJECT AND SUMMARY OF THE INVENTION

The present disclosure seeks to remedy these disadvantages, by proposing a marine rope combining good protection against impact and colonization by marine organisms with good cooling by water, even with large rope diameters. For this, according to a first aspect, this marine rope may comprise a plurality of cores, an individual coating around each core, and a protective sheath around the plurality of cores. Each core of the plurality of cores can comprise a strand of fibers or a braid of fibers and each individual coating can be watertight, so as to prevent the colonization of the corresponding core by marine organisms, and have a melting temperature lower than that of the corresponding core, so as to melt before this core in the event of overheating of the rope, and an elongation at break greater than that of the corresponding core, to prevent it tearing from before the core breaks. The sheath can be permeable so as to allow the passage of water and the circulation of water between the cores.

By means of these arrangements, water can penetrate through the permeable protective sheath and circulate between the cores to cool them, while the individual coatings protect each core from marine organisms, By multiplying the number of cores, large-diameter ropes can be obtained, consequently having a high load capacity, whose cooling in the context of long-term marine mooring, for example mooring of floating platforms, nevertheless remains satisfactory. Thus, the plurality of cores can comprise at least four cores.

When the cores comprise fiber strands, it is necessary to balance the torsional moments induced by tensile forces on these strands. For this, the plurality of cores can comprise as many strands of fibers stranded in one direction as strands of fibers stranded in another opposite direction.

The permeable protective sheath can notably be braided around the plurality of cores, thus allowing high-strength fibers to be used, while ensuring its permeability and therefore the cooling of the cores by the interstices among the braided fibers of this sheath. The permeable protective sheath can notably comprise aramid and/or high-modulus polyethylene to ensure good mechanical protection from impacts. "High-modulus polyethylene" (HMPE) means polyethylene with extremely long molecular chains, i.e., of the order of several hundred thousand monomer units. It is also known by the name ultra-high molecular weight polyethylene (UHMPE or UHMWPE) or high-performance polyethylene (HDPE).

To ensure a good seal of the individual coating around each core and prevent implantation of marine organisms, the individual coating around each core can comprise polyurethane.

To ensure good tensile strength to the rope, the plurality of cores can comprise synthetic fibers, and especially polyester, polyethylene, aramid and/or polyimide fibers.

The present disclosure also concerns a mooring line comprising the abovementioned marine rope, as well as the use of such a mooring line for a floating body, and especially for long-term mooring of a floating platform such as, for example, a wind turbine platform.

BRIEF DESCRIPTION OF THE DRAWINGS

The technical teachings of this disclosure will be better understood and its advantages will appear more clearly upon reading the detailed non-limiting examples. The description refers to the attached drawings, in which.

DETAILED DESCRIPTION OF THE INVENTION

Figure 1A:
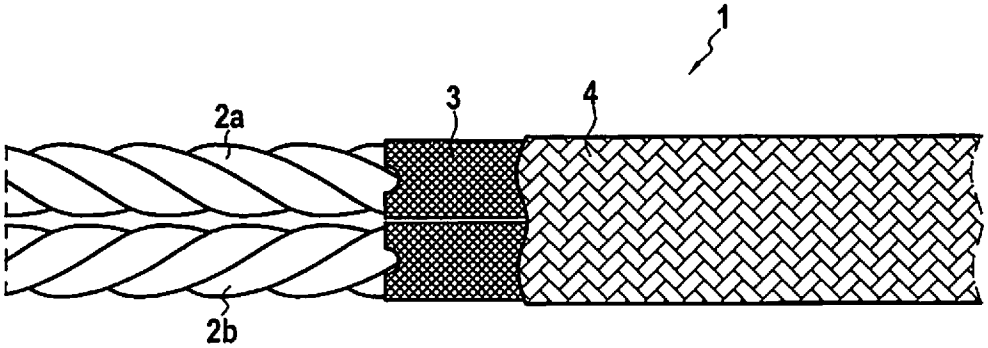
FIG. 1A is an exploded view of a first example of marine rope.
Figure 1B:
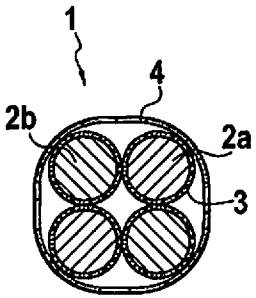
FIG. 1B is a cross-sectional view, along plane IB-IB, of the marine rope of FIG. 1A.

A marine rope 1 according to a first example can comprise, as illustrated in FIGS. 1A and 1B, a plurality of cores 2*a*, 2*b* to transmit tensile forces, an individual coating 3 around each core 2*a*, 2*b* and a permeable protective sheath 4 around the plurality of cores.

As illustrated, each core 2*a*, 2*b* can be formed by a strand of fibers. These fibers can be synthetic fibers, and especially aramid and/or high-modulus polyethylene, providing a very high tensile capacity with a limited weight. In order to equilibrate the moment of torsion generated by pulling on each core 2*a*, 2*b*, the plurality of cores 2*a*, 2*b* may also comprise as many strands of fibers stranded in one direction as strands of fibers stranded in the other direction. Thus, as in the example illustrated in FIGS. 1A and 1B, the plurality of cores 2*a*, 2*b* can comprise two cores 2*a* each formed by a strand turning in a first direction, and two cores 2*b* each formed by a strand turning in a second direction, opposite to the first direction.

In order to protect from marine organisms, and especially mollusks that can nest between the fibers, each core 2*a*, 2*b* can be covered with an individual watertight coating 3. These individual coatings can be of a watertight material having a melting temperature lower than that of the corresponding core and an elongation at break greater than that of the corresponding core. If cores 2*a*, 2*b* are polyester, polyethylene, aramid and/or polyimide fibers, the material for individual coatings 3 can thus be polyurethane, for example.

Finally, permeable protective sheath 4 protects cores 2*a*, 2*b* as well as individual coatings 3, against impacts and friction. As illustrated in FIG. 1A, it can be braided, for example from aramid and/or high-modulus polyethylene fibers, offering good impact resistance and low friction. The braiding can nevertheless be fairly open, so as to allow water to circulate through this sheath 4 to cool cores 2*a*, 2*b* at the interior.

Figure 2A:
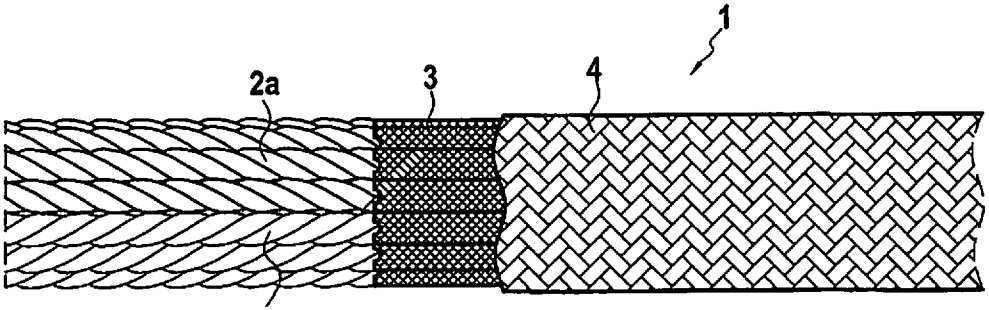
FIG. 2A is an exploded view of a second example of marine rope.
Figure 2B:
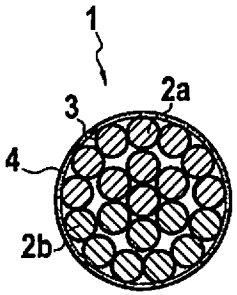
FIG. 2B is a cross-sectional view, along plane IIB-IIB, of the marine rope of FIG. 2A.

Although in this first example illustrated cores 2*a*, 2*b* are four in number, it is also possible to have a higher number. Thus, for example, as shown in the second example illustrated in FIGS. 2A and 2B, cores 2*a*, 2*b* can be eight in number. As in the first example, these cores 2*a*, 2*b* can be formed by fiber strands, and comprise as many fibers stranded in one direction as fibers stranded in another, opposite, direction. Thus, as illustrated in FIGS. 2A and 2B, the plurality of cores 2*a*, 2*b* can comprise ten cores 2*a* each formed by a strand turning in a first direction, and ten cores 2*b* each formed by a strand turning in a second direction, opposite to the first direction. The remaining characteristics of marine rope 1 according to this second example can be identical or similar to those of the first example, and the elements of this rope 1 therefore will be given the same references in these FIGS. 2A, 2B as in FIGS. 1A and 1B.

Figure 3B:
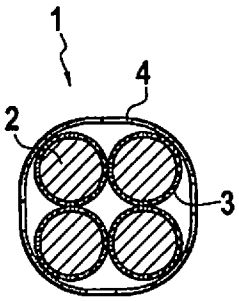
FIG. 3B is a cross-sectional view, along plane IIIB-IIIB, of the marine rope of FIG. 3A.
Figure 3A:
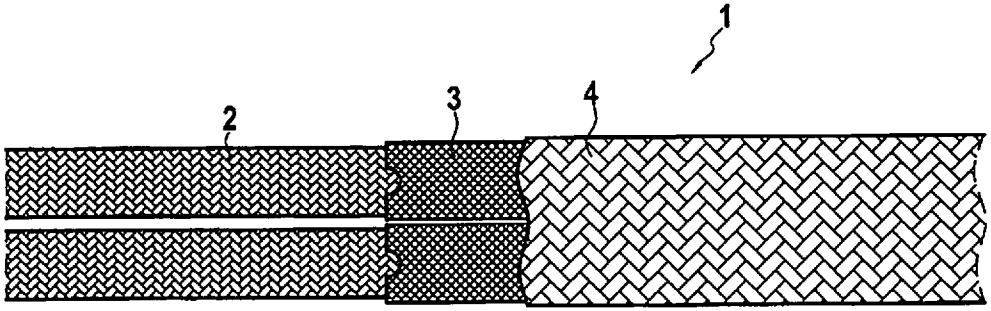
FIG. 3A is an exploded view of a third example of marine rope.
Figure 4B:
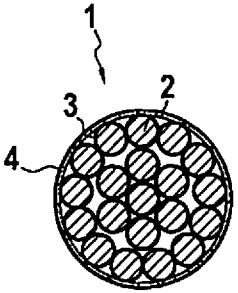
FIG. 4B is a cross-sectional view, along plane IVB-IVB, of the marine rope of FIG. 4A.
Figure 4A:
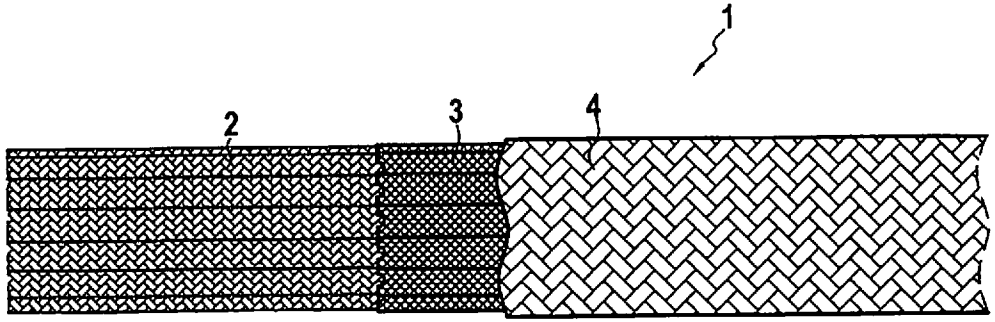
FIG. 4A is an exploded view of a fourth example of marine rope.

Although in the preceding examples cores 2*a*, 2*b* are formed by fiber strands, it is also possible to envisage having marine ropes with 2 cores formed by braids, as illustrated, for example, in FIGS. 3A to 4B. These braids can also be formed by synthetic fibers, and especially aramid and/or high-modulus polyethylene, providing a very high pulling capacity with a limited weight. In the example of FIGS. 3A and 3B, these braided cores 2 are four in number, as in the first example, but it is also possible that they could be greater in number, as in the example of FIGS. 4A and 4B, where they are eight. The remaining characteristics of marine ropes 1 according to these third and fourth examples can be identical or similar to those of the first two examples, and therefore will be given the same references in these FIGS. 3A to 4B as in FIGS. 1A to 2B.

Figure 5:
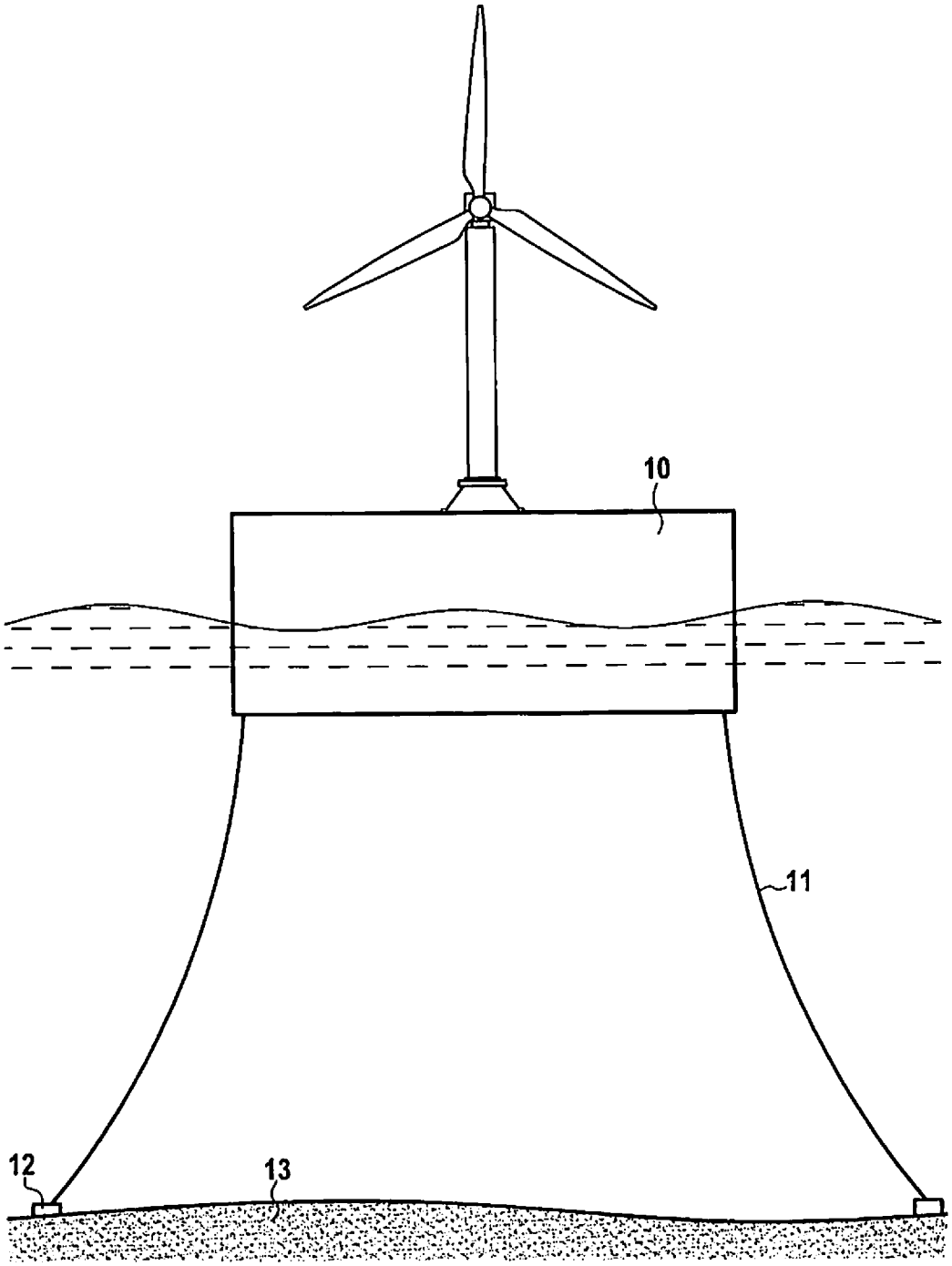
FIG. 5 is a schematic view of a floating platform moored to a seabed by several mooring lines.

These marine ropes 1 can especially be used for mooring lines, such as mooring lines 11 for floating platform 10 illustrated in FIG. 5, that can tie this floating platform 10 to anchors 12 on seabed 13 in order to maintain its position, for example for the use of offshore wind power.

Although the present invention has been described by referring to specific examples of embodiment, it is obvious that various modifications and changes can be made without exceeding the general scope of the invention as defined by the claims. Moreover, individual characteristics of the different examples discussed can be combined into additional embodiments. Thus, for example, it would be possible to envisage combining braided cores and stranded cores in the same rope. Consequently, the description and the drawings should be considered in an illustrative rather than a restrictive sense.

The invention claimed is:

1. A marine rope comprising:

a plurality of cores, each core comprising a strand of fibers or a braid of fibers, an individual coating around each core, each individual coating being watertight and having a melting temperature lower than that of the corresponding core and an elongation at break greater than that of the corresponding core, and a protective sheath around the plurality of cores, wherein the protective sheath is permeable so as to allow the passage of water and the circulation of water between the cores.

2. The marine rope according to claim 1, wherein the plurality of cores comprises at least four cores.

3. The marine rope according to claim 1, wherein the plurality of cores comprises as many strands of fibers stranded in one direction as strands of fibers stranded in another opposite direction.

4. The marine rope according to claim 1, wherein the permeable protective sheath is braided around the plurality of cores.

5. The marine rope according to claim 1, wherein the permeable protective sheath comprises aramid and/or high-modulus polyethylene.

6. The marine rope according to claim 1, wherein the individual coating around each core comprises polyurethane.

7. The marine rope according to claim 1, wherein the plurality of cores comprise synthetic fibers.

8. The marine rope according to claim 7, wherein the synthetic fibers comprise polyester, polyethylene, aramid and/or polyamide fibers.

9. A mooring line comprising the marine rope according to claim 1.

10. A method of using the mooring line according to claim 9 for mooring of a floating body.

* * * * *